US006365836B1

(12) United States Patent
Blouin et al.

(10) Patent No.: US 6,365,836 B1
(45) Date of Patent: Apr. 2, 2002

(54) CROSS WEB FOR DATA GRADE CABLES

(75) Inventors: Denis Blouin, Montreal; Jacques Cornibert, Verdun; Jörg-Hein Walling, Beaconsfield, all of (CA)

(73) Assignee: Nordx/CDT, Inc., Pointe-Claire (CA)

( * ) Notice: Subject to any disclaimer, the term of this patent is extended or adjusted under 35 U.S.C. 154(b) by 0 days.

(21) Appl. No.: 09/343,998

(22) Filed: Jun. 30, 1999

Related U.S. Application Data

(63) Continuation-in-part of application No. 09/258,374, filed on Feb. 26, 1999, now abandoned.

(51) Int. Cl.[7] ..... H01B 11/06
(52) U.S. Cl. ..... 174/113 C
(58) Field of Search ..... 174/113 C, 113 R, 174/131 A; 385/105, 110, 112, 114; 264/1.5, 174

(56) References Cited

U.S. PATENT DOCUMENTS 1,940,917 A * 12/1933 Okazaki ..... 174/113 C
5,920,672 A * 7/1999 White ..... 385/110
5,952,615 A * 9/1999 Prudhon ..... 174/113 C

OTHER PUBLICATIONS

Hawley, "Condensed Chemical Dictionary", pp. 570–571, 1981.*

Images of Belden 1711A Datatwist 300 4PR23 shielded cable, 1995.*

* cited by examiner

*Primary Examiner*—Chau N. Nguyen
(74) *Attorney, Agent, or Firm*—Wolf, Greenfield & Sacks, P.C.

(57) ABSTRACT

A cross web core in a high performance data cable maintains geometric stability between plural twisted pair transmission media and between each twisted pair and the cable jacket. The cross web core may further isolate twisted pairs from each other by including conductive or magnetically permeable materials. By so doing, loss, impedance and crosstalk performance are improved.

8 Claims, 4 Drawing Sheets

CROSS WEB FOR DATA GRADE CABLES

This application is a continuation-in-part of prior U.S. patent application Ser. No. 09/258,374, filed Feb. 26, 1999, now abandoned.

BACKGROUND

1. Field of the Invention

The present invention relates to high performance data cables employing twisted pairs of insulated conductors as the transmission medium. More particularly, the present invention relates to such cables having improved crosstalk performance by use of techniques to separate the twisted pairs from each other and from the cable jacket.

2. Related Art

High performance data cable using twisted pair transmission media have become extremely popular. Such cable constructions are comparatively easy to handle, install, terminate and use. They also are capable of meeting high performance standards.

One common type of conventional cable for high-speed data communications includes multiple twisted pairs. In each pair, the wires are twisted together in a helical fashion forming a balanced transmission line. When twisted pairs are placed in close proximity, such as in a cable, electrical energy may be transferred from one pair of the cable to another. Such energy transfer between pairs is undesirable and is referred to as crosstalk. Crosstalk causes interference to the information being transmitted through the twisted pair and can reduce the data transmission rate and can cause an increase in the bit error rate. The Telecommunications Industry Association (TIA) and Electronics Industry Association (EIA) have defined standards for crosstalk in a data communications cable including: TIA/EIA-568-A, published Oct. 24, 1995; TIA/EIA 568-A-1 published Sep. 25, 1997; and TIA/EIA 568-A-2, published Aug. 14, 1998. The International Electrotechnical Commission (IEC) has also defined standards for data communications cable crosstalk, including ISO/IEC 11801 that is the international equivalent to TIA/EIA 568-A. One high performance standard for data communications cable is ISO/IEC 11801, Category 5.

Crosstalk is primarily capacitively coupled or inductively coupled energy passing between adjacent twisted pairs within a cable. Among the factors that determine the amount of energy coupled between the wires in adjacent twisted pairs, the center-to-center distance between the wires in the adjacent twisted pairs is very important. The center-to-center distance is defined herein to be the distance between the center of one wire of a twisted pair to the center of another wire in an adjacent twisted pair. The magnitude of both capacitively coupled and inductively coupled crosstalk varies inversely with the center-to-center distance between wires, approximately following an inverse square law. Increasing the distance between twisted pairs will thus reduce the level of crosstalk interference. Another important factor relating to the level of crosstalk is the distance over which the wires run parallel to each other. Twisted pairs that have longer parallel runs will have higher levels of crosstalk occurring between them.

In twisted pairs, the twist lay is the longitudinal distance between twists of the wire. The direction of the twist is known as the twist direction. If adjacent twisted pairs have the same twist lay, then the coupling is longitudinally additive. If twisted pairs have opposite twist directions, then they interlace, and their center lines will lie more closely together than they would within a cable in which all pairs have the same twist direction. Thus due to the reduced center to center distance twisted pairs having opposite twist directions will have reduced crosstalk performance. In other words, the crosstalk tends to be higher between pairs having substantially the same twist lay and opposite twist direction.

Therefore, adjacent twisted pairs within a cable are given unique twist lays and the same twist directions. The use of unique twist lays serves to decrease the level of crosstalk between adjacent twisted pairs.

Sometimes, it would be advantageous to also use twisted pairs with opposing twist directions. However, as outlined above, the interlacing between twisted pairs having essentially the same or similar twist lay lengths will increase, thus reducing the crosstalk performance.

Even if each adjacent twisted pairs in cable has a unique twist lay and/or twist direction, other problems may occur. In particular, during use mechanical stress may interlink adjacent twisted pairs. Interlinking occurs when two adjacent twisted pairs are pressed together filling any interstitial spaces between the wires comprising the twisted pairs. Interlinking will cause a decrease in the center-to-center distance between the wires in adjacent twisted pairs and can cause a periodic coupling of two or more twisted pairs. This can lead to an increase in crosstalk among the wires in adjacent twisted pairs within the cable.

One popular cable type meeting the above specifications is foil shielded twisted pair (FTP) cable. FTP cable is popular for local area network (LAN) applications because it has good noise immunity and a low level of radiated emissions.

Another popular cable type meeting the above specifications is unshielded twisted pair (UTP) cable. Because it does not include shield conductors, UTP cable is preferred by installers and plant managers as it is easily installed and terminated. The requirements for modem state of the art transmission systems require both FTP and UTP cables to meet very stringent requirements. Thus, FTP and UTP cables produced today have a very high degree of balance and impedance regularity. In order to achieve this balance and regularity, the manufacturing process of FTP and UTP cables may include twisters that apply a back torsion to each wire prior to the twisting operation. Therefore, FTP and UTP cables have very high impedance regularities due to the randomization of eventual eccentricities in a twisted wire pair during manufacturing.

In order to obtain yet better crosstalk performance in FTP and UTP cables, for example to meet future performance standards, such as proposed category 6 standards, some have introduced a star or cross-shaped interior support for the data cable, such as disclosed by Gaeris et al. in U.S. Pat. No. 5,789,711, issued Aug. 4, 1998.

In conventional cables, the loss factor or loss tangent of the jacketing material has a substantial impact upon the attenuation figure of data grade cables. Attenuation increases with proximity of the transmission media to the jacket. For this reason, data cables not having an interior support such as disclosed by Gaeris et al. generally have loose fitting jackets. The looseness of the jacket reduces the attenuation figure of the cable, but introduces other disadvantages. For example, the loose fitting jacket permits the geometric relationship between the individual twisted pairs to vary, thus varying impedance and crosstalk performance.

In FTP cable, the effect of the loss tangent of the jacketing material is substantially mitigated by the shield. The shielding characteristics of the foil surrounding the twisted pairs determine the effect upon different frequencies. This shielding characteristic is best described by the transfer impedance. However, measurement of the transfer impedance is difficult, especially at higher frequencies.

The performance of shielded cable can be substantially improved by individually shielding the twisted pairs. However, such cables commonly designated as STP (Individually Shielded Twisted Pairs) wires are impractical, as they require a substantial amount of time and specialized equipment or tools for termination. Additionally, the cables themselves are relatively large in diameter due to the added bulk of the shield, which is a severe disadvantage, primarily with respect to causing poor flammability performance, but also with respect to space requirements in ducts and on cross connects.

Conventional interior supports have the basic cross form with parallel sides, such as shown in FIG. 1 or a simple star shape, such as shown in FIG. 2. These shapes have a number of disadvantages, discussed below.

The conventional cable configuration of FIG. 1 includes an interior support 101, a plurality of twisted pairs 102 of insulated conductors 103. Interior support 101 has arms 104 with straight, parallel sides. The entire assembly is surrounded by a jacket (not shown) and possibly by a shield (optional, not shown).

During the stranding operation, in which twisted pairs 102 and the interior support 101 are brought together and twisted into a cable form, the interior support is oriented to the twisted pairs 102 so they can be laid up into the required positions. Then the interior support 101 and twisted pairs 102 are stranded, together. The helical deformation of the interior support 101 stretches the outer, peripheral parts of the support more than the inner parts of the support. This is indicated in FIG. 1 by the dashed lines 105. As the outer peripheral parts of the interior support are stretched and thus thinned, the space in which each individual twisted pair 102 can move is increased. The twisted pairs 102 can move either tangentially to the circumference of the cable or radially, away from the center of the cable. This movement is undesirable, as it causes crosstalk and attenuation variation. Due to the latter, impedance also varies, exhibiting some roughness. Crosstalk is mainly influenced by tangential displacements of the twisted pairs, assuming each pair has a unique lay length to reduce crosstalk. The tangential displacement varies the spacing between pairs. Radial displacement predominantly affects attenuation. Variation in radial displacement cause attenuation variation, also called attenuation roughness, as the distance from the center of each twisted pair to the jacket varies. Both of these variations also incidentally have an impact upon impedance roughness.

The cable shown in FIG. 2 is that disclosed by Gaeris et al. This configuration has an interior support 201 having a plurality of arms 202 with angled sides, giving the interior support an overall star shape. The arms 202 of interior support 201 separate a plurality of twisted pairs 203 of insulated conductors 204. The assembly is shielded by a foil shield 205, and protected by a jacket 206.

SUMMARY OF THE INVENTION

The present invention provides an improved high performance data cable including a generally cross-shaped core.

According to one aspect of the invention, a high performance data cable includes a plurality of twisted pairs of insulated conductors; a generally cross-shaped core having arms with flanged ends extending sufficiently far around each twisted pair of insulated conductors to retain each twisted pair of insulated conductors; and a jacket generally surrounding the plurality of twisted pairs of insulated conductors and the core; whereby the plurality of twisted pairs of insulated conductors are held in stable positions apart from each other and from the jacket. In some embodiments of the cable, adjacent arms define a substantially circular void in which a twisted pair of insulated conductors is retained. In other embodiments of the invention, adjacent arms define a substantially polygonal void in which a twisted pair of insulated conductors is retained.

BRIEF DESCRIPTION OF THE DRAWINGS

In the drawings, in which like reference designations indicate like elements.

DETAILED DESCRIPTION

The present invention will be better understood upon reading the following detailed description in connection with the figures.

Figure 3:
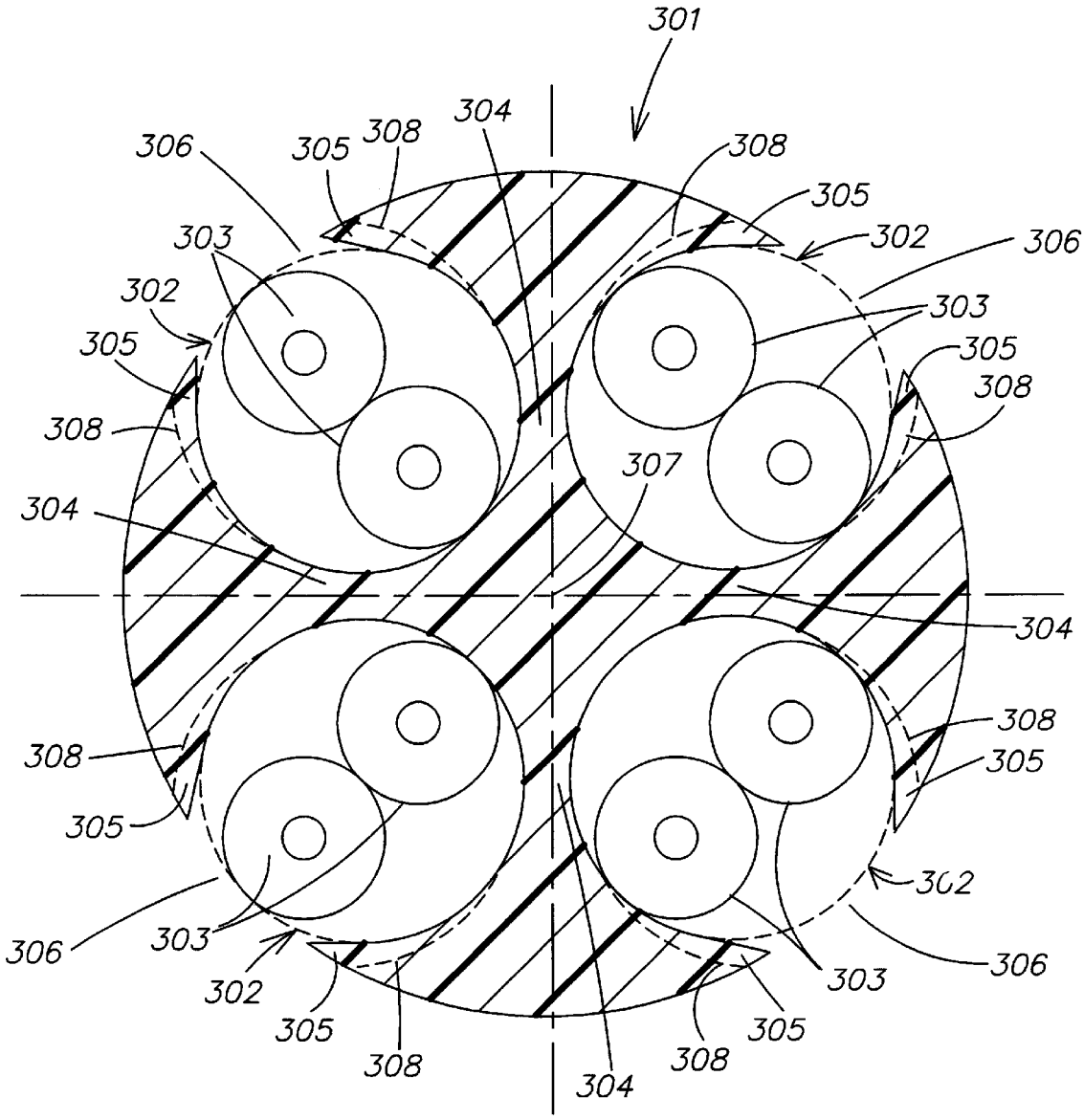
FIG. 3 is a cross-section of a cable according to one embodiment of the invention.

FIG. 3 shows a cross-section of a cable core 301 and four twisted pairs 302 of insulated conductors 303 according to one embodiment of the invention. The core includes four radially disposed arms 304, each having flanged distal ends 305. Each adjacent pair of arms 304 and flanges 305 form a substantially circular void 306 or groove parallel to the central axis 307 of the core 301. The flanges 305 extend part way around the grooves 306, but leave an opening through which the twisted pairs 302 of insulated conductors 303 can be inserted during cable manufacture.

Figure 1:
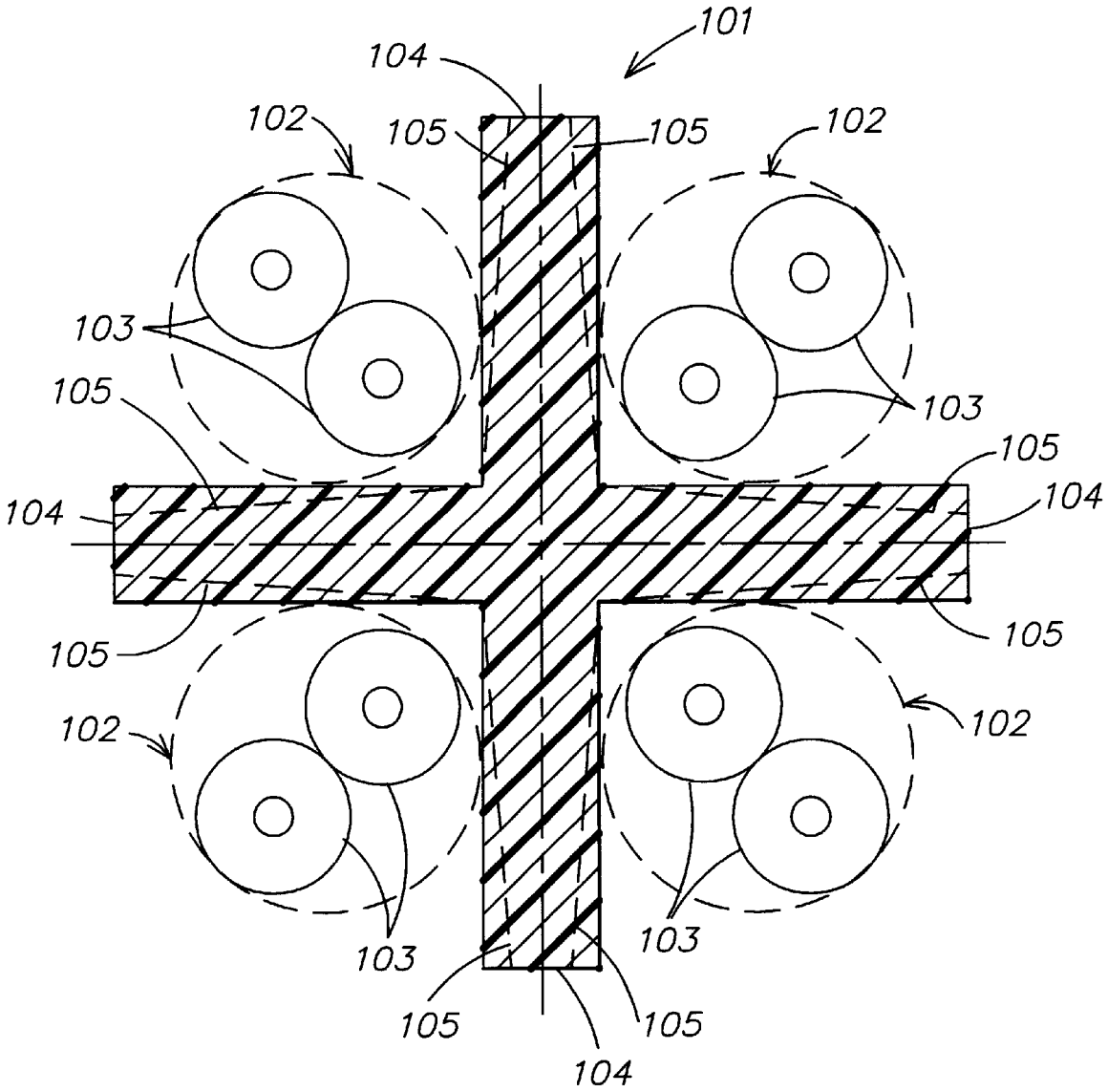
FIG. 1 (PRIOR ART)
FIG. 1 is a cross-section of a prior art cable including an interior support.
Figure 2:
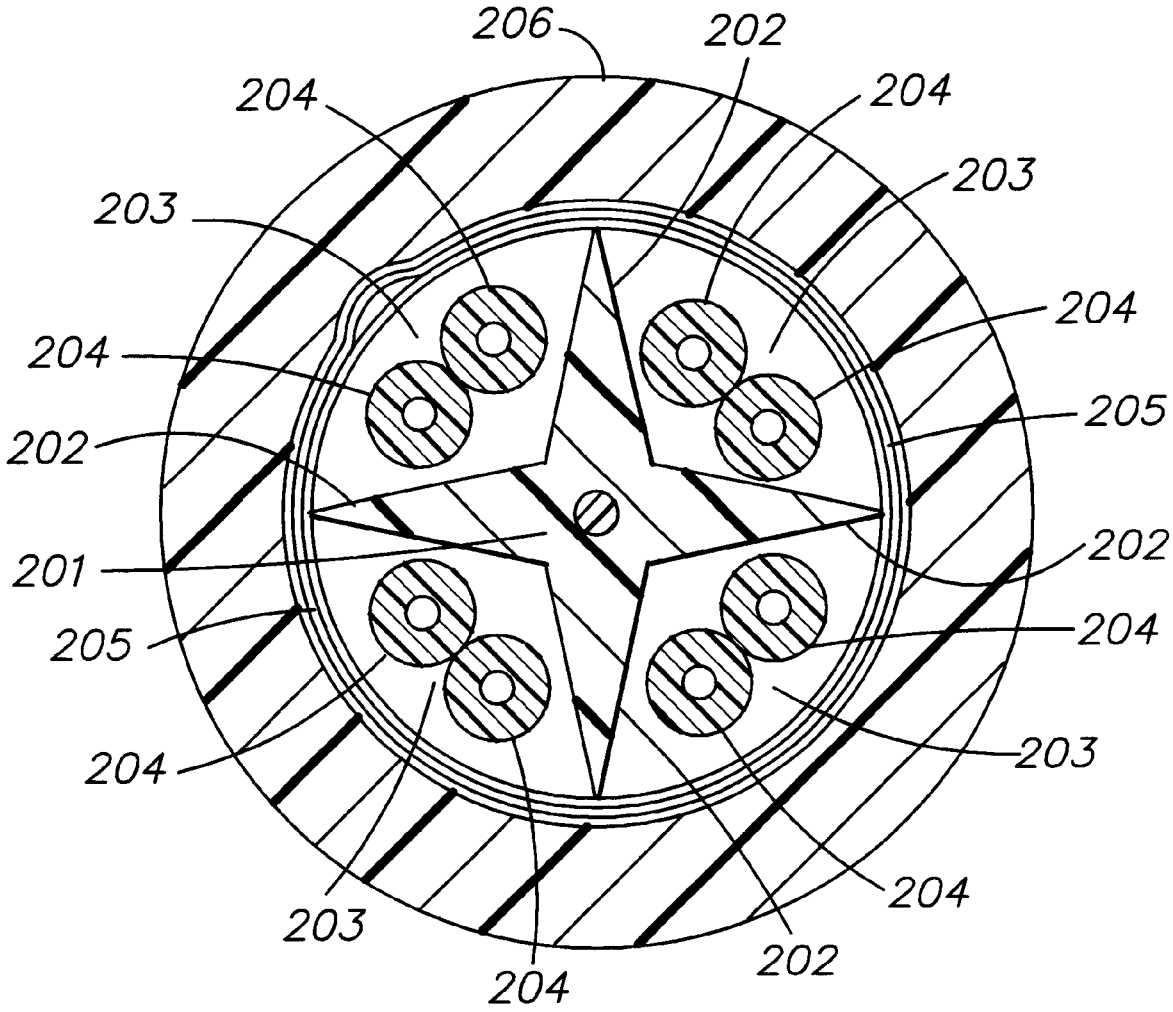
FIG. 2 (PRIOR ART)
FIG. 2 is a cross-section of the cable disclosed by Gaeris et al.

During manufacture, the twisted pairs 302 of insulated conductors 303 are laid up into the voids 306 in the cable core 301. The assembly is then stranded, i.e., twisted to form a cable assembly. Stranding deforms the arms 304 and flanges 305, as indicated by the dashed lines 308. The deformation is more pronounced towards the distal end of the arms 304 and flanges 305. However, this deformation is far less pronounced than that present in prior art designs, such as shown in FIGS. 1 and 2.

To correct this deformation, the flanges may be made a bit thicker, in order to compensate for the deformation that occurs during the stranding operation.

According to one embodiment, the cross web core should be formed of a material having a low loss tangent. Thus, the attenuation of the completed cable can be minimized. Suitable materials include, but are not limited to polyolefins or any other low dielectric loss fluoropolymer. To reduce the dielectric loss yet further, or allow use of higher loss materials, the cross web core may be a foamed material. Foamed materials can further improve overall attenuation and both attenuation and impedance roughness because air or other foaming gasses generally have lower dielectric loss than the unfoamed material.

A second embodiment of the invention is now described in connection with FIG. 4. This embodiment is more economical from the standpoint of the quantity of material used to construct the core. In this embodiment, the voids formed by the flanged arms are substantially polygonal. Moreover, unnecessary material at the ends of the arms has been omitted.

In this embodiment of the invention, the elements of the cable core 401 have substantially straight sides. Arms 402 has straight parallel sides, ending at the distal end in flanges 403. Flanges 403 also have straight sides. Flanges 403 and arms 402 are arranged to leave a void 404 at the end thereof. Adjacent arms 402 and flanges 403 form grooves or channels 405, which receive the twisted pairs 406 of insulated conductors 407, as described above in connection with grooves or channels 306 shown in FIG. 3.

Figure 4:
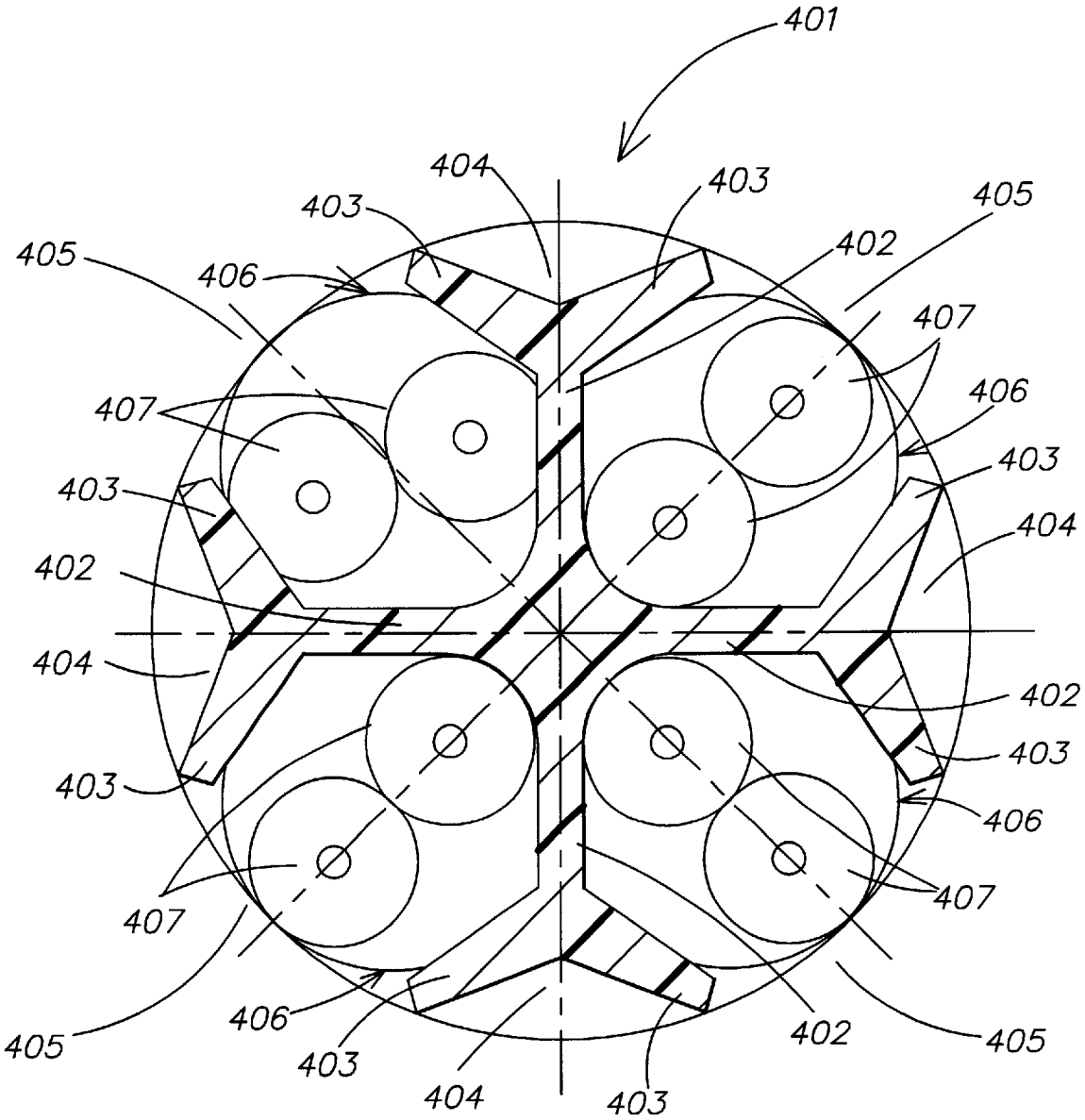
FIG. 4 is a cross-section of a cable according to another embodiment of the invention.

The cable formed using the embodiment of either FIG. 3 or FIG. 4 is completed by applying a jacket 310 to the exterior thereof. The arms and flanges maintain the jacket at a fixed distance away from the twisted pairs of insulated conductors.

In each embodiment of the invention, the cable core separates and stabilizes the relative positions of the twisted pairs of insulated conductors. The arms of the core separate the twisted pairs, while the arms and flanges cooperate to retain the twisted pairs in fixed relative positions. This improves the crosstalk performance of the new cable. Moreover, the flanges space the jacket away from the twisted pairs of insulated conductors, reducing the attenuation due to the loss tangent of the jacket material. Therefore, the jacket can be more tightly applied, further stabilizing the mechanical and electrical characteristics of the resulting cable.

As explained above, important electrical characteristics of finished cable include, but are not limited to, attenuation, attenuation roughness, impedance and impedance roughness. The overall geometry of a cable and the consistency with which the cable components maintain that geometry substantially affects the noted characteristics.

Embodiments of the invention improve the noted cable characteristics by establishing and maintaining over the length of the cable a beneficial geometric relationship between and among twisted pairs and the cable jacket. The arms and flanges of embodiments of the invention may just barely maintain the jacket away from the twisted pairs or may substantially maintain the jacket away from the twisted pairs, provided the geometry remains constant over the length of the cable.

The following embodiments of the present invention push the performance of FTP cable close to that of STP cable. This can be accomplished by using a cross web core as described above, whose surface or body has been rendered conductive, for example, by depositing a metallic shielding material onto the plastic.

Metallic depositions can be made on the cross web core either electrolytically or using a current less process. Suitable materials are, for instance, nickel, iron and copper. The first two materials having the added advantage of superior shielding effectiveness for a given coating thickness due to the relatively high permeability of those materials.

Hence, if the cross web core is covered with or formed of an electrically conductive material, preferably a material also having a high permeability, then an improvement of the shielding effectiveness can be obtained. The conductive surfaces of the cross web core should be longitudinally in contact with the surrounding foil shield. In this way the cross web core and the foil shield combine to form shielded sectored compartments for each twisted pair. In fact, if the shielding material on or forming the cross web core has a sufficient thickness to provide shielding equivalent to the shielding effectiveness of the surrounding foil shield, then performance close to STP cable can be attained. Thus, cables can be designed which have geometric characteristics similar or identical to high performance FTP cable while having substantially the electric performance of STP cable.

The foregoing cable employing a conductively coated cross web core is advantageous in another, unexpected way. By shielding the twisted pairs from the material of the cross web core, the inventive construction of this embodiment renders the loss tangent of the cross web core material unimportant. Therefore, the material of the cross web core may be chosen without regard for its loss tangent, but rather with regard to such considerations as cost, flammability, smoke production and flame spread.

Conductive cross web cores including suitable shielding materials can be produced a variety of ways. The surface of a non-conductive polymeric cross web can be rendered conductive by using conductive coatings, which could also be polymeric. Another possibility is to use a sufficiently conductive polymer to construct the cross web core.

One process which can produce a suitable coating is electrolytic metalization. However, the penetration of the coating into the grooves or channels of the cross web core during production is a bit more difficult. This process tends to produce an accumulation of deposited metal at the tips of the cross web core arms or flanges. Another possibility would be to deposit the metal in a current less process. The most common metals used for these processes are nickel and copper. Alternatively, the cross web cores could be metalized by vapor deposition.

As mentioned above, conductivity can be achieved by use of conductive materials for the cross web core material. Moreover, other coatings can be combined with a cross web core of a ferrite-loaded polymer, in order to decrease pair-to-pair coupling. Such a cross web core material provides magnetic properties which improve the cross talk isolation. Moreover, if such a cross web core is additionally metalized at the surface, then the metal coating can be substantially smaller than in the previously described designs.

The present invention has now been described in connection with a number of specific embodiments thereof However, numerous modifications which are contemplated as falling within the scope of the present invention should now be apparent to those skilled in the art. Therefore, it is intended that the scope of the present invention be limited only by the scope of the claims appended hereto.

What is claimed is:

1. A high performance data cable comprising:

a plurality of twisted pairs of insulated conductors;

a generally cross-shaped core having arms with flanged ends extending sufficiently far around each twisted pair of insulated conductors to retain each twisted pair of insulated conductors in stable positions apart from each other, thereby controlling cross-talk between adjacent twisted pairs whose distance apart does not vary during cable installation and use; and a jacket generally surrounding the plurality of twisted pairs of insulated conductors and the core and held at a substantially constant distance away from each twisted pair of insulated conductors by the arms of the cross-shaped core, thereby controlling attenuation variation due to a loss tangent of the jacket;

wherein two adjacent arms of the cross-shaped core define a substantially polygonal void in which one of the twisted pairs of insulated conductors is retained.

2. The high performance data cable of claim 1, wherein two adjacent arms of the cross-shaped core maintain the jacket at a fixed distance away from the twisted pairs of insulated conductors.

3. The high performance data cable of claim 1, wherein the generally cross-shaped core comprises:

a conductive material.

4. The high performance data cable of claim 3, wherein the conductive material is a surface coating on the generally cross-shaped core.

5. The high performance data cable of claim 3, wherein the conductive material defines the cross-shaped core.

6. The high performance data cable of claim 3, wherein the cross-shaped core further comprises:

a material having high permeability.

7. The high performance data cable of claim 4, wherein the conductive material also has high permeability.

8. The high performance data cable of claim 5, wherein the conductive material also has high permeability.

* * * * *

UNITED STATES PATENT AND TRADEMARK OFFICE

CERTIFICATE OF CORRECTION

PATENT NO. : 6,365,836 B1 
DATED : April 2, 2002
INVENTOR(S) : Blouin, Denis, Cornibert, Jaques and Walling, Jörg-Hein It is certified that error appears in the above-identified patent and that said Letters Patent is hereby corrected as shown below:

Column 2,
Line 35, please replace "modem" with -- modern --.

Signed and Sealed this

Eleventh Day of June, 2002

*Attest:*

*Attesting Officer*

JAMES E. ROGAN
*Director of the United States Patent and Trademark Office*